US012090603B2

(12) United States Patent
Woodson et al.

(10) Patent No.: US 12,090,603 B2
(45) Date of Patent: Sep. 17, 2024

(54) SAFETY GUARDS AND EQUIPMENT FOR USE IN THE PREPARATION OF TEST SPECIMENS

(71) Applicant: Ecolab USA Inc., St. Paul, MN (US)

(72) Inventors: Tannon Shane Woodson, Houston, TX (US); Karina Eureste, Iowa Colony, TX (US)

(73) Assignee: ECOLAB USA INC., Saint Paul, MN (US)

( * ) Notice: Subject to any disclaimer, the term of this patent is extended or adjusted under 35 U.S.C. 154(b) by 560 days.

(21) Appl. No.: 17/385,060

(22) Filed: Jul. 26, 2021

(65) Prior Publication Data

US 2022/0023995 A1 Jan. 27, 2022

Related U.S. Application Data

(60) Provisional application No. 63/056,950, filed on Jul. 27, 2020.

(51) Int. Cl.
*B24B 55/04* (2006.01)
*B24B 5/01* (2006.01)
(Continued)

(52) U.S. Cl.
CPC ..... *B24B 55/04* (2013.01); *B24B 5/01* (2013.01); *B24B 5/04* (2013.01); *B24B 5/36* (2013.01);
(Continued)

(58) Field of Classification Search
CPC .... B24B 5/01; B24B 5/04; B24B 5/36; B24B 5/363; B24B 21/006; B24B 21/02;
(Continued)

(56) References Cited

U.S. PATENT DOCUMENTS 2,550,765 A * 5/1951 Brown ..... B24D 15/066 451/523
4,736,545 A 4/1988 Moss
(Continued)

FOREIGN PATENT DOCUMENTS

CN 107336140 A 11/2017
CN 1100395451 A 7/2019
(Continued)

OTHER PUBLICATIONS

"Hilda Electric Grinding Dust Transparent Safety Shield Grinder Accessory 400W Aluminum Skull Grinders", downloaded from https://www.aliexpress.com/item/32561580289.html on May 1, 2020, 5 pages.

*Primary Examiner* — Eileen P Morgan
(74) *Attorney, Agent, or Firm* — Kagan Binder, PLLC

(57) ABSTRACT

A system for polishing an outer surface of a specimen, the system including a motor and a rotatable shaft extending from a first end of the motor, wherein the specimen is removably attachable to the rotatable shaft, a safety cover configured to at least partially surround at least a portion of the rotatable shaft, wherein the safety cover includes a top panel, a first side panel and a second side panel spaced from each other across a width of the safety cover and extending downwardly from the top panel, and at least one aperture extending through at least one of the first and second side panels. The system further includes an abrasive material insertable through the at least one aperture so that the abrasive material is positionable to contact the outer surface of the specimen.

12 Claims, 9 Drawing Sheets

(51) Int. Cl.

| | |
|---|---|
| ***B24B 5/04*** | (2006.01) |
| ***B24B 5/36*** | (2006.01) |
| ***B24B 21/02*** | (2006.01) |
| ***B24B 21/20*** | (2006.01) |
| ***B24B 23/06*** | (2006.01) |
| ***B24B 55/05*** | (2006.01) |

(52) U.S. Cl.
CPC ..... *B24B 21/02* (2013.01); *B24B 21/20* (2013.01); *B24B 23/06* (2013.01); *B24B 55/057* (2013.01)

(58) Field of Classification Search
CPC ..... B24B 21/20; B24B 23/06; B24B 55/04; B24B 55/05; B24B 55/057; B24D 15/04
USPC ..... 451/59, 307, 313, 317, 318, 355, 451, 451/457, 458, 513, 523
See application file for complete search history.

(56) References Cited

U.S. PATENT DOCUMENTS 5,056,266 A 10/1991 Norris
5,381,630 A 1/1995 Kinner
5,437,125 A * 8/1995 Barton, II ..... B24B 19/12 451/25
5,643,062 A * 7/1997 Joseph ..... A45D 29/14 451/461
5,775,974 A * 7/1998 Hulsebus ..... B24B 33/081 451/28
5,984,767 A * 11/1999 Pineau ..... B24B 35/00 451/302
6,135,861 A * 10/2000 Schaack ..... B24B 35/00 451/49
6,179,689 B1 * 1/2001 Ohno ..... B24B 13/00 451/305
6,383,063 B1 * 5/2002 Ohashi ..... B24B 21/06 451/303
6,491,573 B1 * 12/2002 Barton, II ..... B24B 5/42 451/317
7,794,306 B2 * 9/2010 Kondo ..... B24B 5/42 451/49
9,296,082 B1 * 3/2016 Kesvanathan ..... B24B 21/08
9,550,266 B2 1/2017 Ma et al.
10,086,496 B2 10/2018 Chen
2008/0194185 A1 * 8/2008 Rowlen ..... B24B 29/08 451/303
2022/0055175 A1 * 2/2022 Li ..... B65D 83/0817

FOREIGN PATENT DOCUMENTS

EP 1864754 A1 12/2007
GB 2360476 A * 9/2001 ..... B24B 23/005

* cited by examiner

SAFETY GUARDS AND EQUIPMENT FOR USE IN THE PREPARATION OF TEST SPECIMENS

PRIORITY CLAIM

This application claims the benefit of U.S. Provisional Patent Application No. 63/056,950, filed Jul. 27, 2020, and titled "SAFETY GUARDS AND EQUIPMENT FOR USE IN THE PREPARATION OF TEST SPECIMENS" the entire contents of which are incorporated herein by reference in its entirety.

TECHNICAL FIELD

The present invention relates to safety guards and equipment for use with polishing and/or grinding equipment in the preparation of test specimens.

BACKGROUND

Typical petroleum products that are moved through pipelines desirably do not contain any water that can cause pipe corrosion. This is also true of other liquid hydrocarbon products that are not water soluble. However, water is often inadvertently introduced into petroleum products in a number of different ways, such as through condensation or system leakage, for example. As long as the amount of water does not exceed a certain threshold, the product will still be considered acceptable for use. Because water can cause unwanted pipe corrosion without the use of corrosion inhibitors, it is common to add such inhibitors to the petroleum in an amount that reflects the anticipated amount of water that will be present.

In order to evaluate the properties of these petroleum products that contain corrosion inhibitors, specific test methods have been developed, one of which is described in ASTM D665, for example. As a part of this test method, a cylindrical steel test specimen must be prepared at the testing site immediately prior to immersing it into a test petroleum product specimen. The test method includes specific speeds at which a test specimen must be rotated while its outer surfaces are being contacted with an abrasive cloth or paper. The abrasive must be presented at various angles relative to the test specimen in order to prepare multiple surfaces of the test specimen. Because the test specimen is being rotated at relatively high speeds during grinding and polishing of its surfaces, there is a desire to provide safety guards or covers and equipment to shield workers from metal particles while not interfering with the worker's ability to prepare the specimens.

SUMMARY

Safety covers or guards and associated equipment described herein are used in the preparation of test specimens that are rotating at a relatively high rate of speed while being contacted with an abrasive material. Because surfaces of the test specimens that are to be processed are provided at different angles, the safety guards are desirably provided with multiple access slots or openings at corresponding angles through which the abrasive materials can be inserted. The safety guards are preferably movable, such as pivotal about a hinge, so that the specimens can be accessed for attachment to the rotatable shaft prior to processing and for removal from the rotatable shaft after processing.

In accordance with embodiments described herein, a safety cover is described and illustrated for use in processing a rotatable specimen that is removably attachable relative to a shaft extending from a first end of a motor. The safety cover includes a movable protective shield having a closed position in which at least a portion of the protective shield at least partially surrounds the shaft, and an open position in which the shaft is accessible by a user. The movable protective shield includes an inner area at least partially defined by at least one side portion extending downwardly from a top portion, a bottom opening at least partially defined by a bottom edge of the at least one side portion, and at least one primary opening extending through the at least one side portion and configured for accepting an abrasive material for contact with an outer cylindrical surface of the specimen.

The side portions of the safety cover may include first and second side portions spaced across a width of its inner area with access slots through each of them, and its protective shield may be shaped as an inverted, generally U-shaped portion. The safety cover may include a fixed portion to which the movable protective shield is pivotably connected, which may be accomplished with at least one hinge. Alternatively, the movably protective shield may be removably attached in a different way, such as with a sliding engagement, clips, and/or the like. The system may further include a connector assembly attachable to a shaft of the motor. The openings extending through the side portions may include any or all of horizontal slot(s), vertical slot(s) and angled slot(s).

In accordance with embodiments described herein, a safety cover is described for use in processing a specimen that is removably attachable to a rotatable shaft extending from a first end of a motor. The safety cover includes a closed position configured to at least partially surround at least a portion of the rotatable shaft, an open position in which the rotatable shaft is accessible by a user, a top panel, a first side panel and a second side panel spaced from each other across a width of the safety cover and extending downwardly from the top panel, and at least one aperture extending through at least one of the first and second side panels. The safety cover is configured to accept an abrasive material that is insertable through the at least one aperture for positioning the abrasive material to contact an outer surface of the specimen.

In accordance with embodiments described herein, a system is described for polishing an outer surface of a specimen, the system including a motor and a rotatable shaft extending from a first end of the motor, wherein the specimen is removably attachable to the rotatable shaft, a safety cover configured to at least partially surround at least a portion of the rotatable shaft, wherein the safety cover includes a top panel, a first side panel and a second side panel spaced from each other across a width of the safety cover and extending downwardly from the top panel, and at least one aperture extending through at least one of the first and second side panels. The system further includes an abrasive material insertable through the at least one aperture so that the abrasive material is positionable to contact the outer surface of the specimen.

Methods for preparing an outer surface of a test specimen are described herein, which include the steps of operatively attaching a first end of the specimen to a rotatable shaft extending from a motor; positioning a safety cover in a closed position to at least partially cover the specimen and the rotatable shaft, wherein the cover comprises at least a first aperture extending through the safety cover; activating the motor to cause rotation of the shaft and attached specimen; inserting a first abrasive material through the first aperture so that it contacts a portion of a cylindrical outer surface of the specimen; and rotating the rotatable shaft and attached specimen to polish the portion of the outer cylindrical surface of the specimen with the first abrasive material.

Additional methods for preparing an outer surface of a test specimen are described herein, which can include the following steps: operatively attaching a first end of specimen to a rotatable shaft extending from a first end of a motor; positioning a safety cover in a closed position to at least partially cover the specimen and rotatable shaft, wherein the cover comprises at least a first opening extending through a movable protective shield of the safety cover; activating the motor to cause rotation of the shaft and attached specimen; inserting a first abrasive material through the first opening until it contacts a cylindrical portion of the outer surface of the specimen while the specimen is rotating; and polishing the cylindrical portion of the outer surface of the specimen with the first abrasive material.

The methods may also include inserting a second abrasive material into a second opening while the specimen is rotating, the second opening extending through the movable protective portion of the safety cover, wherein the second abrasive material is inserted into the second opening simultaneously or at a different time from the step of inserting the first abrasive material into the first opening, and polishing a shoulder portion of the outer surface of the specimen that is generally perpendicular to the cylindrical portion. The methods may also include inserting a third abrasive material into a third opening while the specimen is rotating, the third opening extending through the movable protective portion of the safety cover, wherein the third abrasive material is inserted into the third opening simultaneously or at a different time from the step of inserting the first abrasive material into the first opening, and polishing an end tip portion of the outer surface of the specimen that extends generally from the cylindrical portion.

BRIEF DESCRIPTION OF THE DRAWINGS

The present invention will be further explained with reference to the appended Figures, wherein like structure is referred to by like numerals throughout the several views, and wherein.

DETAILED DESCRIPTION

Figure 1:
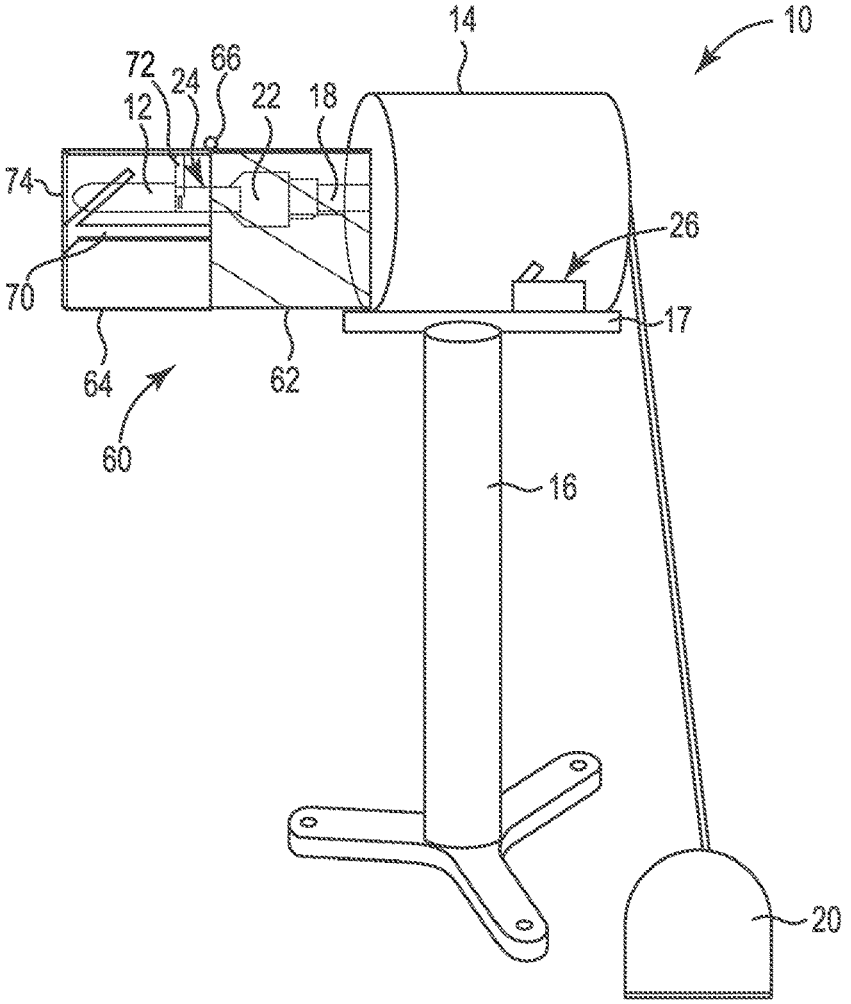
FIG. 1 is a schematic perspective view of an embodiment of a system for preparing a test specimen, including a safety cover in its closed position.
Figure 2:
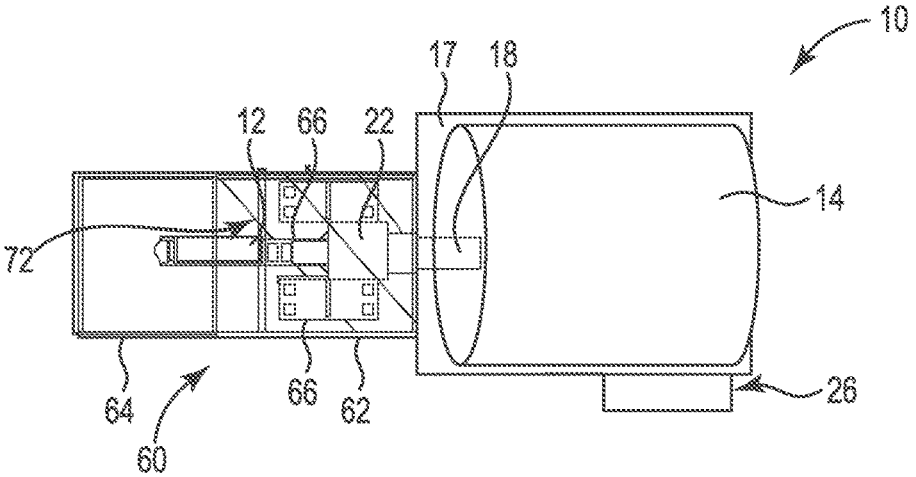
FIG. 2 is a schematic top view of the embodiment of the system illustrated in FIG. 1.

Referring now to the Figures, and initially to FIGS. 1 and 2, an embodiment of a system 10 is schematically illustrated for grinding and/or polishing an outer surface of a test specimen 12 to prepare it for a testing process. An exemplary test specimen 12 is illustrated also in FIG. 3, which is one configuration of a test sample that can be used in testing processes as described herein. In particular, the specimen 12 can be prepared at a testing site prior to immersing it into a test petroleum product sample to determine the corrosive properties of that particular test petroleum product. In some cases, this preparation of the test specimen occurs immediately prior to its use in a testing process. If the test specimen were instead prepared and then allowed to sit in ambient conditions for an extended period of time prior to immersion in the test petroleum product sample, the results of that test would not be as accurate as one in which immersion occurs immediately after the test specimen is prepared.

Figure 3:
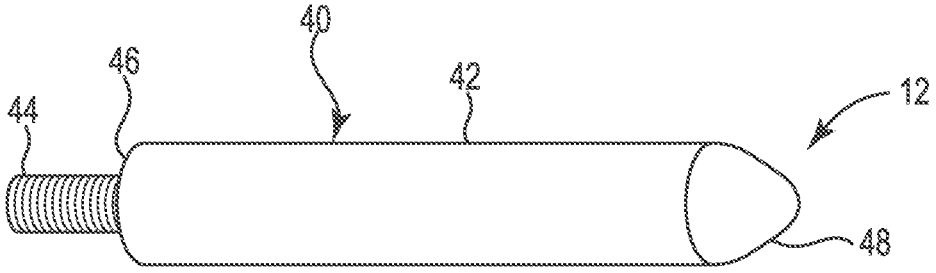
FIG. 3 is a side view of an embodiment of a test specimen used with the systems discussed herein.

Referring also to FIG. 3, this exemplary embodiment of test specimen 12 includes a generally cylindrical body portion 40 having an outer cylindrical surface 42. Body portion 40 includes a proximal end 46 from which a threaded connection portion 44 extends, although it is contemplated that the test specimen may include a different configuration for its proximal end. A distal end of test specimen 12 includes a generally cone-shaped tip 48. In the preparation of a test specimen with this configuration, abrasive material must be presented at various angles relative to the test specimen in order to contact the multiple surfaces of the test specimen.

Exemplary test specimens 12 that can be prepared in accordance with method and equipment described herein may be made of steel, for example. In a particular exemplary embodiment, test specimen 12 is fabricated from a steel rod that is approximately 81.0 mm long and approximately 12.7 mm in diameter, wherein the overall length includes a connector portion or member that is approximately 12.7 mm long. However, the test specimens can instead have one or more dimensions that are different from this exemplary test specimen.

With reference again to FIGS. 1 and 2, system 10 includes a motor 14 mounted to a grinder stand 16, which is one of a wide variety of configurations for a stand on which the motor 14 can be mounted. In this configuration, the grinder stand 16 of system 10 sits on the floor with the motor 14 mounted on a platform 17 at the top of the grinder stand 16.

In this way, the motor 14 can be easily accessed by an operator standing next to the equipment. However, in another example, the stand on which the motor 14 is mounted can instead be mounted to a tabletop for access by an operator who is sitting. In any case, the height of the stand on which the motor is mounted may be adjustable to accommodate users of different heights and/or preferences.

Certain methods for processing test specimens include specific speeds at which each test specimen is to be rotated while its outer surfaces are being contacted with an abrasive cloth or paper. Although the abrasives used can include any of a wide variety of abrasive material sheets, exemplary abrasive materials include emery cloth or sandpaper, such as 100 grit, metalworking, J-weight silicon carbide abrasive cloth or aluminum oxide paper sheets. Different abrasive materials can be chosen, depending on the condition of the test specimen, the desired level of grinding and polishing to be accomplished with a specific step, and other factors.

A wide variety of motors can be used to achieve desired rotation speeds for the test specimens 12. Motor 14 can therefore be any general-purpose motor with an extending shaft 18 that rotates within the speed range required by a particular test specimen preparation method. For one testing method that is described in ASTM D665, for example, the rotation of the test specimen is required to be in a range of 1700 to 1800 rpm for both preliminary grinding and final surface preparation. One exemplary motor that can be used for such an operation is a ¼ HP general purpose motor commercially available from the Dayton Electric Mfg. Co. of Lake Forest, Illinois as manufacturer model number 5K191BG.

The motor 14 may be controlled by an operator using a number of different control devices or methods. The embodiment of FIGS. 1 and 2 includes an activation switch 20 that can be used in cases where a user is standing and can press his or her foot on the switch 20 to control the motor 14. The switch 20 may be used for activation of the motor 14 and/or used as a "kill switch" for deactivation of the motor. Such a deactivation can occur simply by removal of foot pressure on the switch, or may require removal of foot pressure followed by another pressing of the activation switch 20, for example. The motor 14 can alternatively or additionally be controlled by a manual control 26, which may include any type of hand-operated switch, dial, or the like, and may be located in any accessible operating location. The motor 14 can instead be activated in another manner, such as a hand-held device or other activation device known in the industry.

The system 10 further includes a connector assembly 22 extending from a distal end of an extending shaft 18. Connector assembly 22 can be attached to the shaft 18 in such a way that it is intended to be permanently or semi-permanently attached, or can be configured for easy removal and replacement from the shaft 18. A distal end 24 of connector assembly 22 is configured for removal and replacement of test specimens 12. In an embodiment, the distal end of the connector assembly includes a threaded receiver portion for engagement with a threaded connection member or portion 44 of a test specimen 12. In other embodiments, the connector assembly can instead include a chuck or other configuration that provides for attachment with an end of a test specimen. It is possible that the connection requires the use of tools or that attachment of the test specimens can be performed by hand without the use of tools.

In order to shield an operator's hands from contact with a rotating test specimen 12 during processing, the system 10 further includes a safety cover 60 having an optional fixed portion 62 to which a movable protective shield 64 is attached. In other embodiments, however, that the movable protective shield portion of a safety cover is instead movably attached to another structure that is not part of the safety cover.

Figure 4:
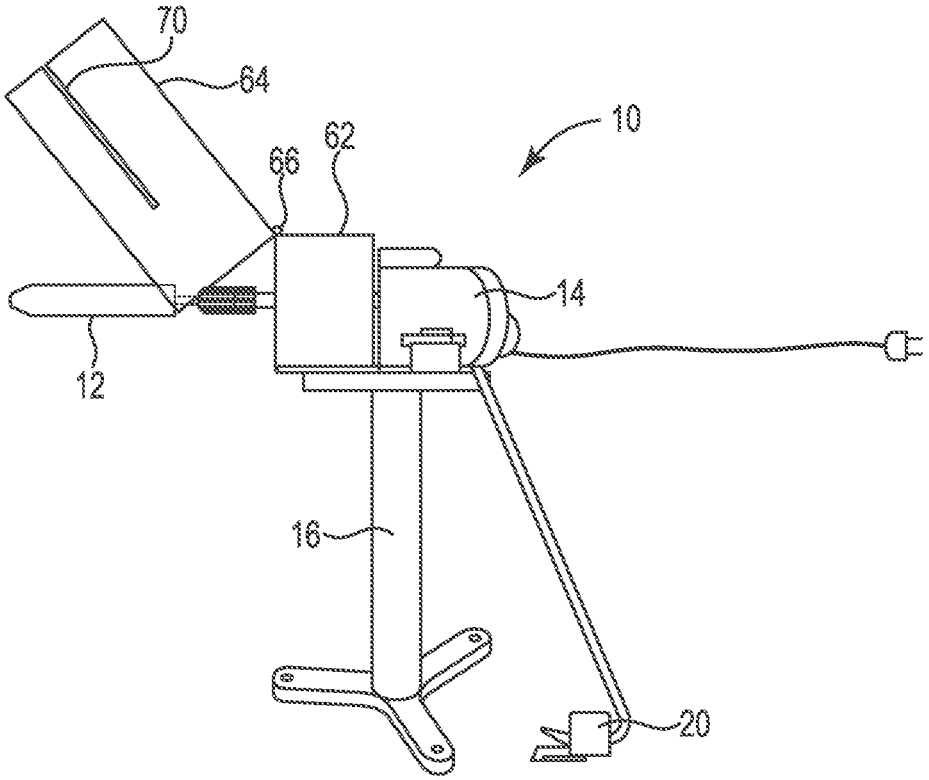
FIG. 4 is a schematic side view of an embodiment of a system for preparing an outer surface of a specimen, including a safety cover in its open or semi-open position.
Figure 5:
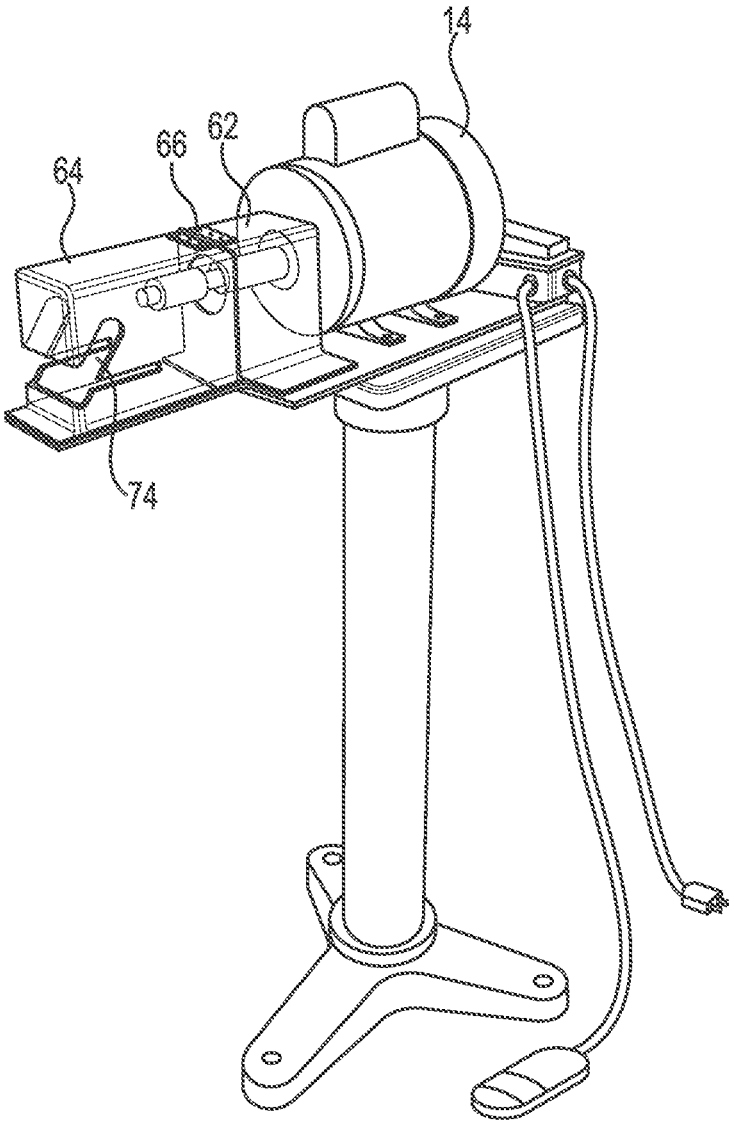
FIG. 5 is another perspective view of an embodiment of a system for preparing an outer surface of a test specimen, including a safety cover in its closed position.
Figure 6:
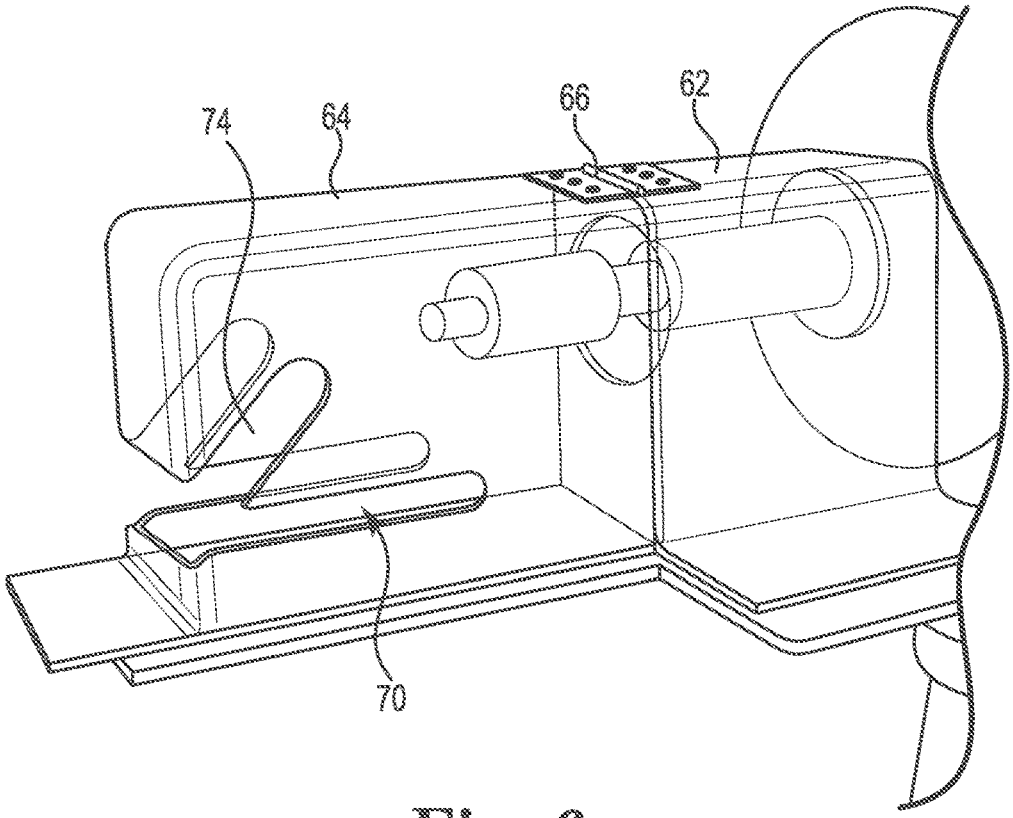
FIG. 6 is a perspective view of an upper portion of the system of FIG. 5.
Figure 7:
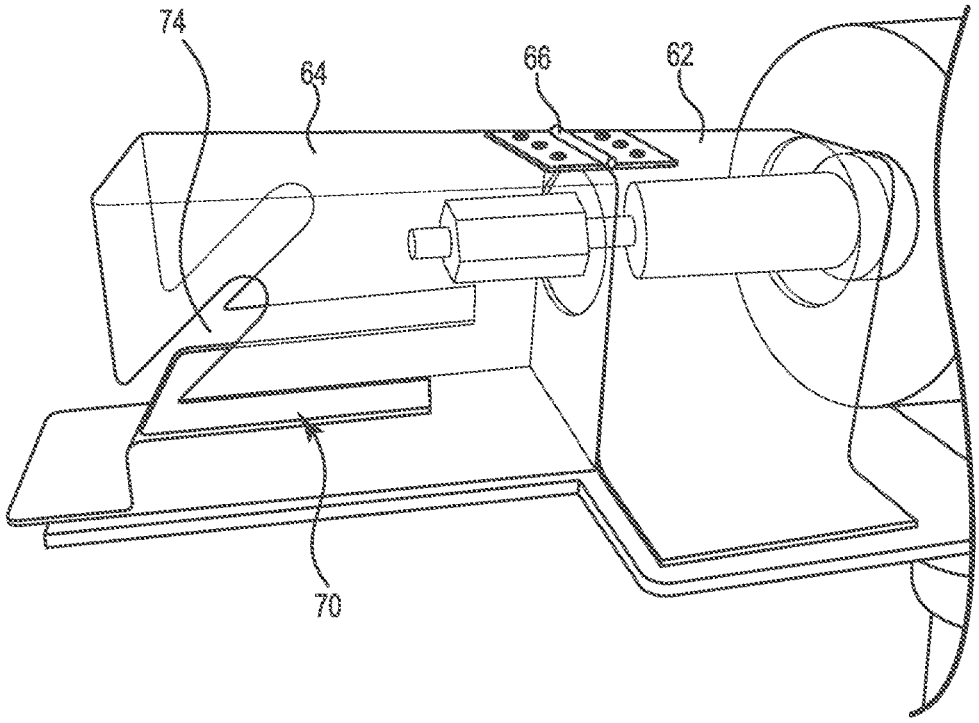
FIG. 7 is a side view of an upper portion of the system of FIG. 5.
Figure 8:
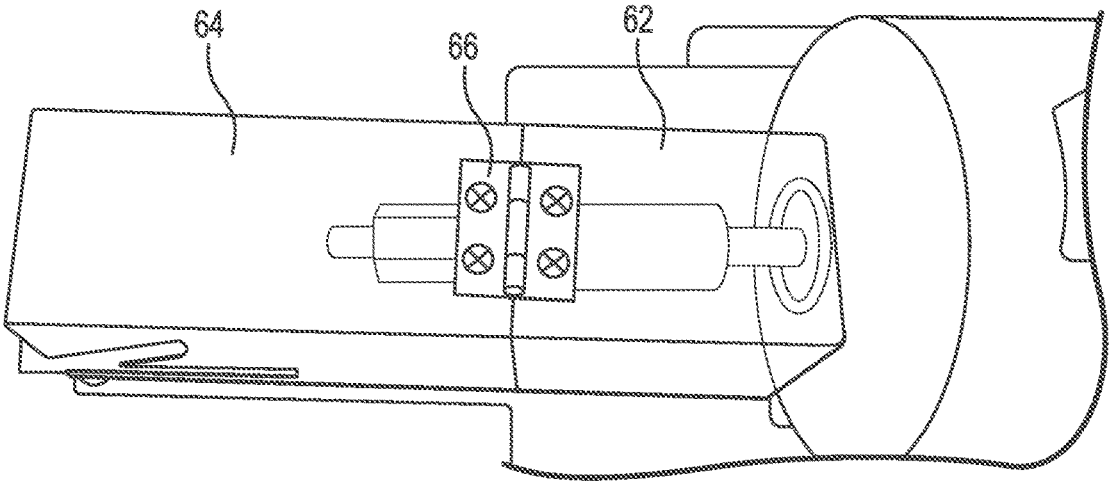
FIG. 8 is a top view of an upper portion of the system of FIG. 5.
Figure 9:
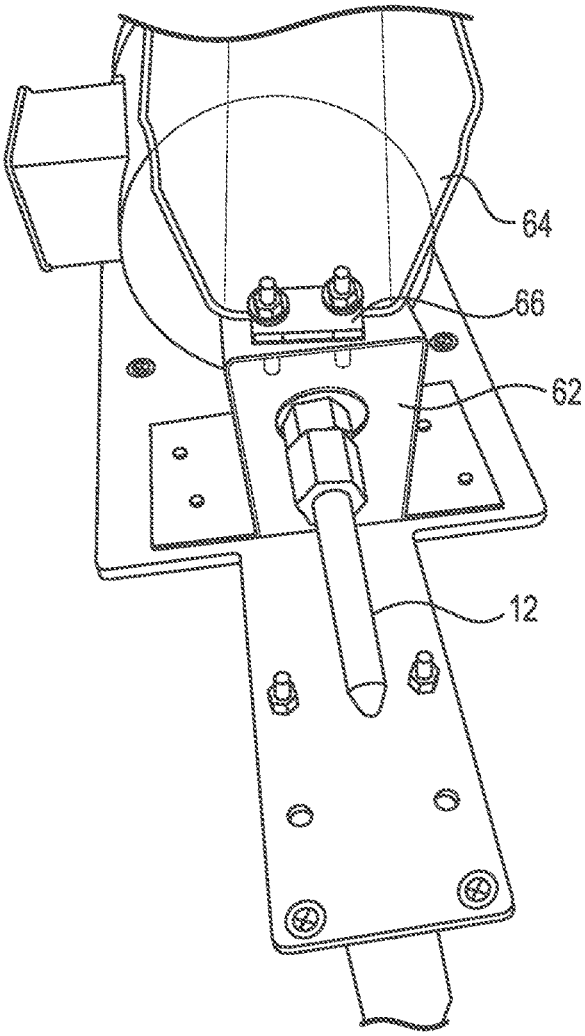
FIG. 9 is a top perspective view of an upper portion of an embodiment of the system of FIG. 5, with the safety cover in an open or semi-opened position and with a test specimen mounted to a motor shaft.

The various safety cover features described relative to system 10 are illustrated in the various views of FIGS. 1-3 and 5-9. In this embodiment, the movable protective shield 64 is attached to the fixed portion 62 via one or more hinges 66 about which the protective shield 64 can pivot between its open and closed positions. Protective shield 64 is configured in FIGS. 1 and 2 so that it pivots upwardly from a closed, horizontal orientation toward an open, vertical orientation when access to the area of the extending shaft 18 of motor 14 is desired. FIG. 4 illustrates this protective shield 64 in its open or semi-open position in which it has been pivoted upwardly about its hinge(s) 66. However, it is contemplated that the hinges are instead positioned on one of the sides or the bottom portion of the safety cover 60. It is further contemplated that the movable portion of a safety cover is movable in a different way than pivoting about a hinge, such as a sliding configuration, a clipped connection, or the like. In any of these configurations, it is desirable for the protective shield 64 to be sized and configured so that when it is open or off, a user can easily access the test specimen 12 for its attachment to and removal from the shaft 18 extending from motor 14.

The safety cover 60 further includes one or more slots or openings through which abrasive material can be inserted to allow a user to grind or polish surfaces of a test specimen with the safety cover 60 in its closed position. In one embodiment, these slots or openings extend through the protective shield 64 of the safety cover 60, although it is possible that at least a portion of one or more of these slots extends through the fixed portion 62 of the safety cover 60. The safety cover 60 may include all of the slot configurations described below, or may include only some of these slots for situations where only some of the surfaces need to be abraded.

Figure 10:
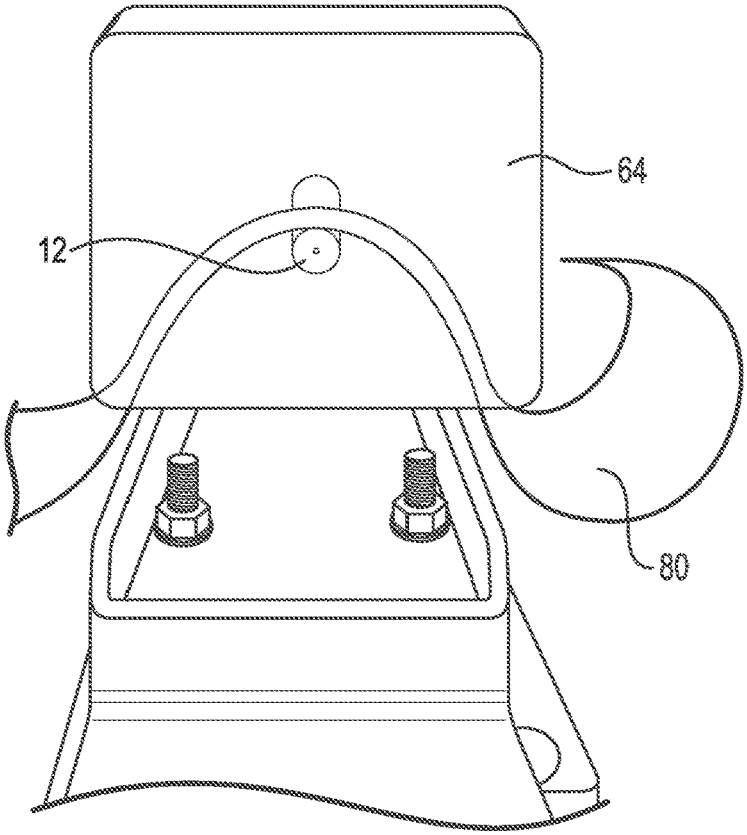
FIG. 10 is a front view of an upper portion of the system of FIG. 5, including abrasive extending through side openings of its safety cover.
Figure 11:
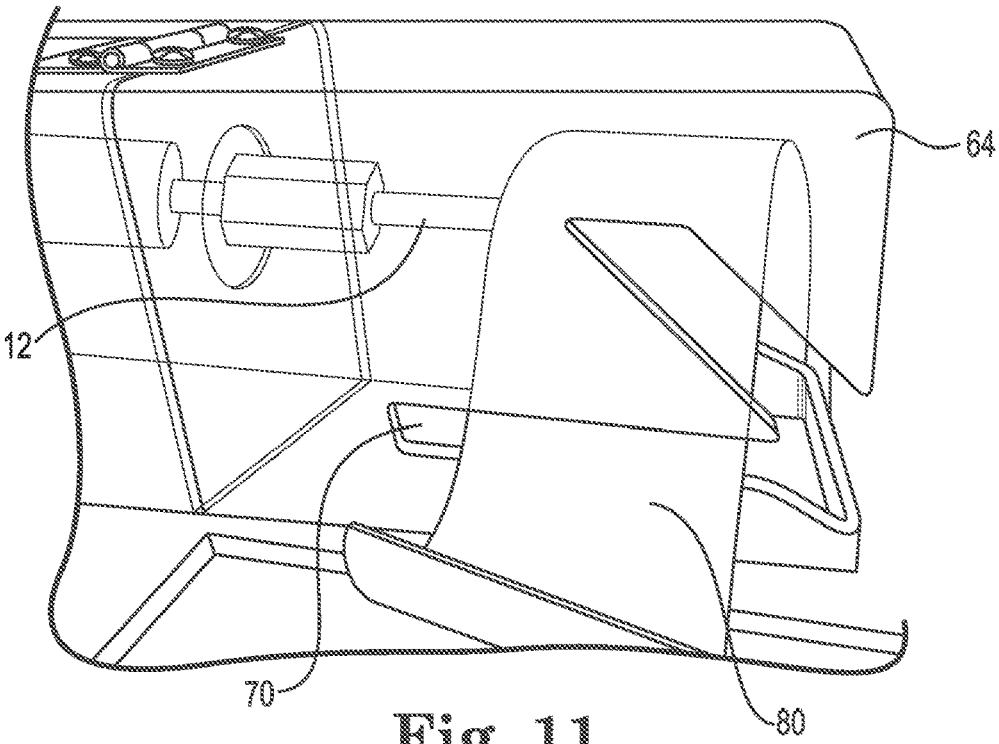
FIG. 11 is a side view of the system illustrated in FIG. 5, including abrasive extending through side openings of its safety cover.

As shown in the embodiment of FIGS. 1 and 2, the safety cover 60 includes at least one slot 70 that extends through both of its sides that are generally horizontally oriented when the protective shield 64 is in its closed position. These horizontal slots 70 are positioned for the use of abrasive to grind and/or polish the main outer surface 42 of the cylindrical body portion 40 of test specimen 12. Referring also to FIGS. 10 and 11, for example, abrasive material 80 extends across the width of the protective shield 64 and through horizontal slots 70 on each side of the shield 64. As shown, abrasive material 80 is draped over the top of the test sample 12 with its abrasive side in contact with the cylindrical body portion 40 for abrading this surface when the motor 14 is activated.

Safety cover 60 also includes at least one slot 72 extending in a generally vertical orientation when the protective shield 64 is in its closed position. Slot(s) 72 are positioned for the use of abrasive to grind and/or polish proximal end 46 of the cylindrical body portion 40 of test specimen 12. Abrasive material will be inserted into the slot(s) 72 and positioned with its abrasive side in contact with the proximal end 46 of the cylindrical body portion 40 for abrading this surface when the motor 14 is activated.

Safety cover 60 also includes at least one slot 74 extending in a generally angled orientation when the protective shield 64 is in its closed position, such that the slot(s) 74 include a vertical component and a horizontal component.

Slot(s) 74 are positioned for grinding and/or polishing the cone-shaped tip 48 of test specimen 12. Abrasive material will be inserted into the slot(s) 74 and positioned with its abrasive side in contact with the cone-shaped tip 48 for abrading this surface when the motor 14 is activated.

Figure 12:
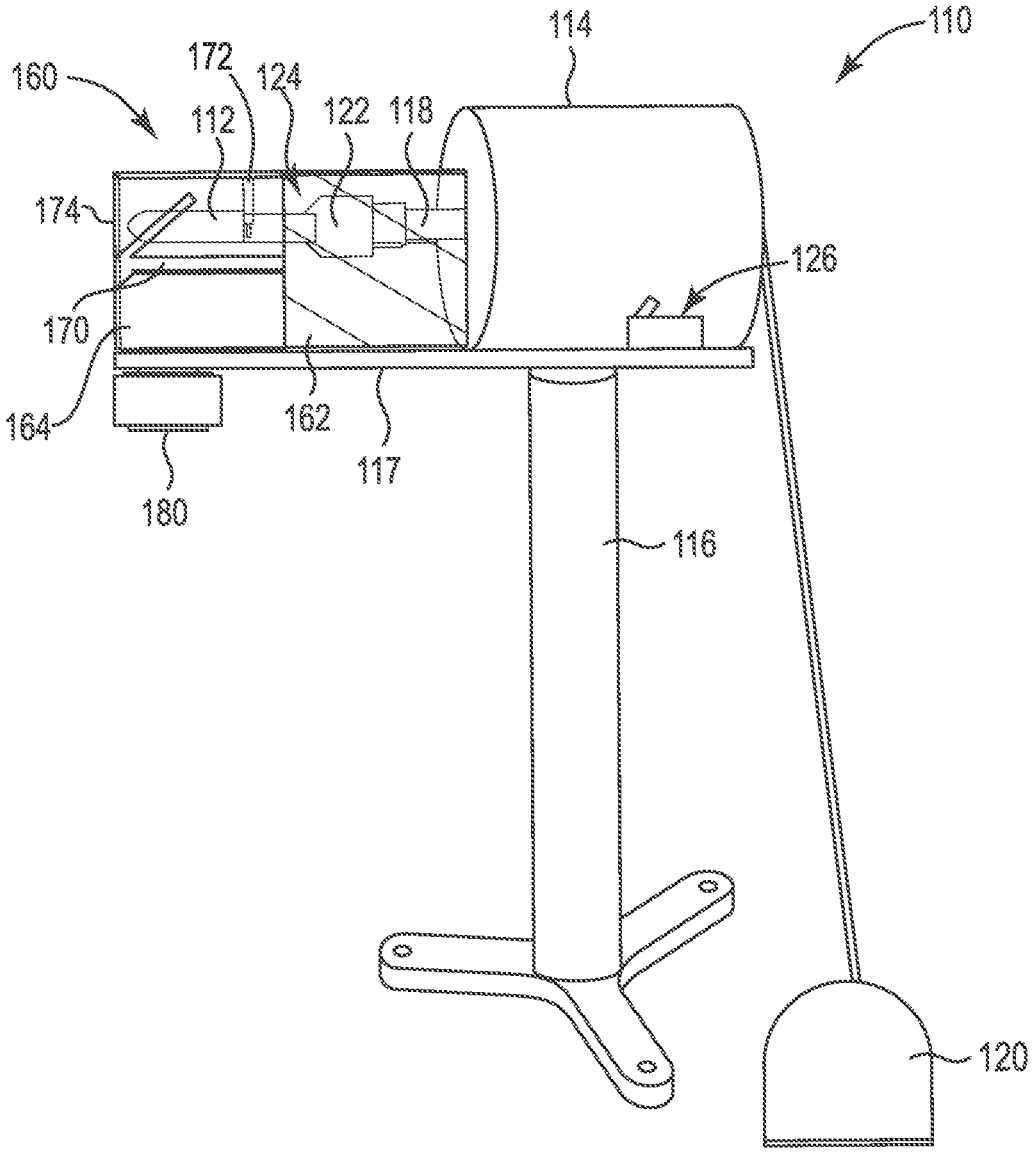
FIG. 12 is a schematic side view of an embodiment of a system for preparing a test specimen, with its safety cover in a closed position.

FIG. 12 is a schematic illustration of an embodiment of a system 110 for grinding and/or polishing an outer surface of a test specimen 112 that may be similar to the test specimen 12 described above. System 110 includes a motor 114 mounted to a grinder stand 116, which is shown as one of a wide variety of configurations for a stand on which the motor 114 can be mounted. In this configuration, the system 110 sits on the floor with the motor 114 mounted on a motor/grinder plate 117 at the top of the grinder stand 116 so that it can be easily accessed by an operator standing next to the equipment. As shown, plate 117 extends under the motor 114 and also under the area where the test specimen 112 is mounted to the motor 114. However, in another example, the stand on which the motor 114 is mounted can instead be mounted to a tabletop for access by an operator who is sitting. In any case, the height of the stand on which the motor is mounted may be adjustable to accommodate users of different heights.

The motor 114 may be controlled by an operator using a number of different control devices or methods. For one example, an activation switch 120 is provided for cases where a user is standing and can press his or her foot on the switch 120 to control the motor 114. The switch 120 may be used for activation of the motor 114 and/or used as a "kill switch" for deactivation of the motor. Such a deactivation can occur simply by removal of foot pressure on the switch, or may require removal of foot pressure followed by another pressing of the activation switch 120, for example. The motor 114 can alternatively or additionally be controlled by a manual control 126, which may include any type of hand-operated switch, dial, or the like, and located in any convenient operating location. The motor 114 can instead be activated in another manner, such as a hand-held device or other activation device known in the industry.

The system 110 further includes a connector assembly 122 extending from a distal end of a shaft 118 that extends from the motor 114. Connector assembly 122 can be attached to the shaft 118 in such a way that it is intended to be permanently or semi-permanently attached, or can be configured for easy removal and replacement from the shaft 118. A distal end 124 of connector assembly 122 is configured for removal and replacement of test specimens 112. In an embodiment, the distal end of the connector assembly includes a threaded receiver portion for engagement with a threaded connection member of a test specimen 112.

System 110 further includes a safety cover 160 having an optional fixed portion 162 to which a movable protective shield 164 is attached. In this embodiment, the protective shield 164 is attached to the fixed portion 162 via one or more hinges about which the protective shield 164 can pivot between its open and closed positions. It is desirable for the protective shield 164 to be sized and configured so that when it is open, a user can easily access the test specimen 112 for its attachment to and removal from the shaft 118.

The safety cover 160 further includes one or more slots or openings through which abrasive material can be inserted to allow a user to grind or polish surfaces of a test specimen with the safety cover 160 in its closed position. These slots may include any or all of horizontal slots 170, vertical slots 172, and angled slots 174 that are configured similar to slots 70, 72, 74 described above, for example. Alternatively, slots can be positioned in different locations and oriented differently than illustrated herein in order to position abrasive material to grind and/or polish different surfaces and/or using different approaches.

This embodiment of polishing system 110 further includes a magnetic source 180 illustrated schematically as a disc shaped element under the motor/grinder plate 117, although it can be positioned in a different location relative to the components of this system. The magnetic source 180 can be activated by the user during the grinding operation to gather metal particles that are ground from the surface of the test specimen 112 during the abrading processes. The magnetic source can be controllable by an operator or automatically controlled by a control system.

Figure 13:
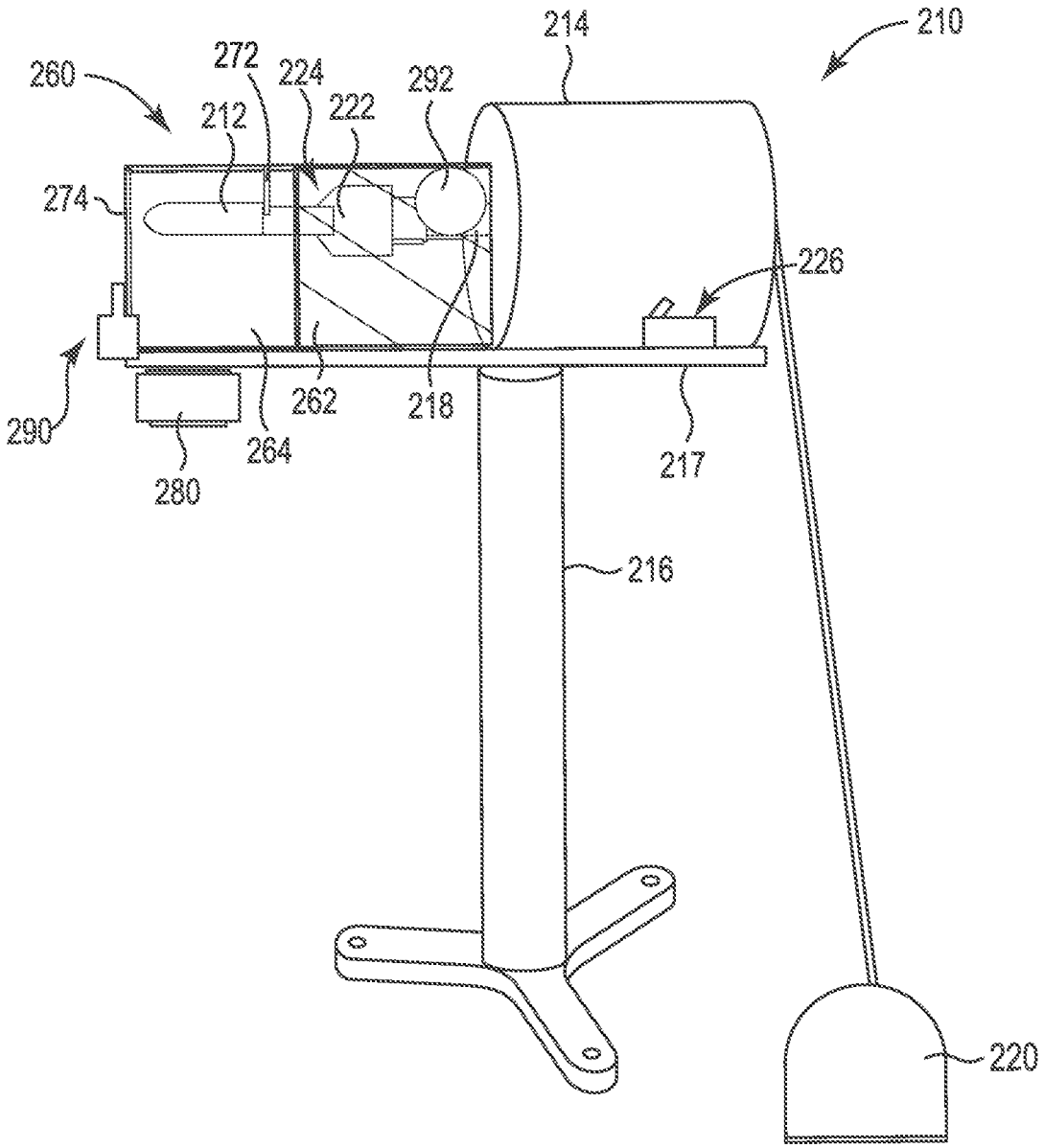
FIG. 13 is a schematic side view of an embodiment of a system for preparing a test specimen, with its safety cover in a closed position.

FIG. 13 is a schematic illustration of an embodiment of a system 210 for grinding and/or polishing an outer surface of a test specimen 212 that may be similar to the test specimen 12 described above. System 210 includes a motor 214 mounted to a grinder stand 216, which is shown as one of a wide variety of configurations for a stand on which the motor 214 can be mounted. In this configuration, the system 210 sits on the floor with the motor 214 mounted on a motor/grinder plate 217 at the top of the grinder stand 216 so it is easily accessed by an operator standing next to the equipment. As shown, plate 217 extends under the motor 214 and also under the area where the test specimen 212 is mounted to the motor 214. However, in another embodiment, the stand on which the motor 214 is mounted can instead be mounted to a tabletop for access by an operator who is sitting. In any case, the height of the stand on which the motor 214 is mounted may be adjustable to accommodate users of different heights.

The motor 214 may be controlled by an operator using a number of different control devices or methods. For one example, an activation switch 220 is provided for cases where a user is standing and can press his or her foot on the switch 220 to activate the motor 214. The switch 220 may also be configured for use as a "kill switch" for deactivation of the motor. Such a deactivation can occur simply by removal of foot pressure on the switch, or may require removal of foot pressure followed by another pressing of the activation switch 220, for example. The motor 214 can alternatively or additionally be controlled by a manual control 226, which may include any type of hand-operated switch, dial, or the like. The motor 214 can instead be activated in another manner, such as a hand-held device or other activation device known in the industry.

The system 210 further includes a connector assembly 222 extending from a distal end of a shaft 218 that extends from the motor 214. Connector assembly 222 can be mounted to the shaft 218 in such a way that it is intended to be permanently or semi-permanently attached, or can be configured for easy removal and replacement from the shaft 218. A distal end 224 of connector assembly 222 is configured for removal and replacement of test specimens 212. In an embodiment, the distal end of the connector assembly includes a threaded receiver portion for engagement with a threaded connection member of a test specimen 212.

System 210 further includes a safety cover 260 having a fixed portion 262 to which a movable protective shield 264 is attached. In this embodiment, the protective shield 264 is attached to the fixed portion 262 via one or more hinges about which the protective shield 264 can pivot between its open and closed positions. It is desirable for the protective shield 264 to be sized and configured so that when it is in its open position, a user can easily access the test specimen 212 for its attachment to and removal from the shaft 218.

The safety cover 260 further includes one or more slots or openings through which abrasive material can be inserted to allow a user to grind or polish surfaces of a test specimen with the safety cover 260 in its closed position. These slots may include any or all of horizontal slots, vertical slots, and angled slots that are configured similar to slots 70, 72, 74 described above, for example, wherein FIG. 13 only illustrates a slot 274. Alternatively, slots can be positioned in different locations and oriented differently than illustrated herein in order to position abrasive material to grind and/or polish different surfaces and/or using different approaches.

This embodiment of polishing system 210 further includes a magnetic source 280 illustrated schematically as a disc shaped element under the motor/grinder plate 217, although it can be positioned in a different location relative to the components of this system. The magnetic source 280 can be activated by the user during the grinding operation to gather metal particles that are ground from the surface of the test specimen 212 during the abrading processes.

Polishing system 210 further includes an optional shield interlock switch shown schematically with reference numeral 290. Such an interlock switch 290 is configured such that the movable protective shield 264 must be in its closed position before it is possible to activate the motor 214. Opening the protective shield 264 while the motor 214 is running would therefore cause the motor 214 to shut off. Although the switch 290 is illustrated at a front end area of the movable protective shield, it can instead be positioned at another location relative to the components of this system in which it provides the function of disabling the motor unless the shield is in its closed position.

Polishing system 210 further includes an optional outlet 292 to which a vacuum system can be mounted. Such a vacuum system can also be used to gather particles that are ground from the surface of the test specimen 212 during the abrading process. The vacuum system can include a fan blade attached to the motor shaft, a hose attached to vacuum, or another vacuum configuration. The vacuum system can be controllable by an operator or automatically controlled by a control system.

Figure 14:
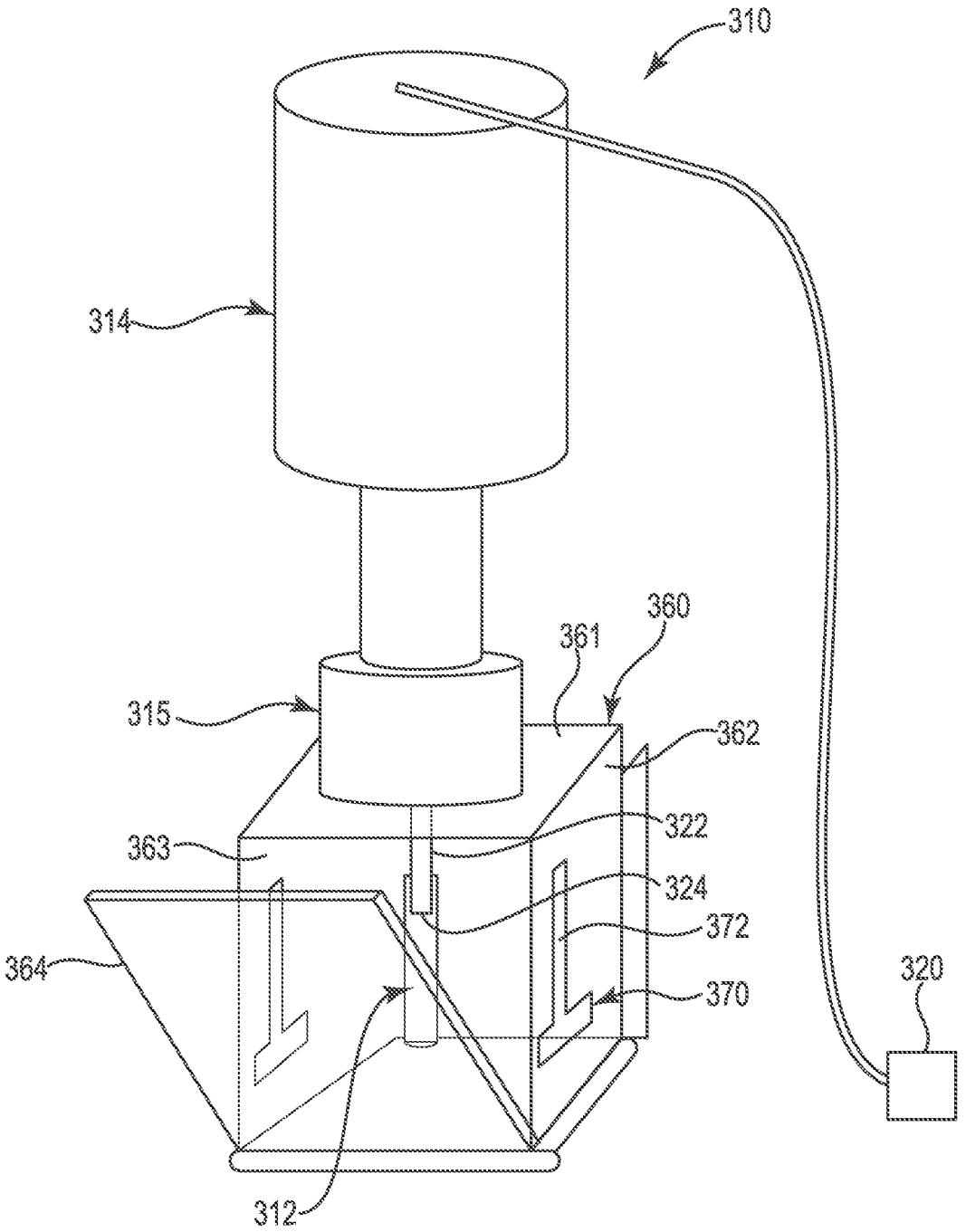
FIG. 14 is a schematic side view of an embodiment of a system for preparing a test specimen, with its safety cover in a partially-open position.

FIG. 14 is a schematic illustration of an embodiment of a system 310 for grinding and/or polishing an outer surface of a test specimen 312 that may be similar to the test specimen 12 described above. System 310 includes a motor 314 from which an optional grinder shield 315 extends. In this configuration, the motor 314 is generally oriented so that a rotating shaft 318 that extends from it is facing in a generally downward orientation.

The motor 314 may be controlled by an operator using a number of different control devices or methods. For one example, an activation switch 320 is provided for cases where a user is standing and can press his or her foot on the switch 320 to control the motor 314. The switch 320 may be used for activation of the motor 314 and/or used as a "kill switch" for deactivation of the motor. Such a deactivation can occur simply by removal of foot pressure on the switch, or may require removal of foot pressure followed by another pressing of the activation switch 320, for example. The motor 314 can alternatively or additionally be controlled by a manual control, which may include any type of hand-operated switch, dial, or the like, and located in any convenient operating location. The motor 314 can instead be activated in another manner, such as a hand-held device or other activation device known in the industry.

The system 310 further includes a connector assembly 322 extending from the motor 314. Connector assembly 322 can be permanently or semi-permanently attached to a rotatable shaft extending from the motor 314, and/or can be configured for easy removal and replacement. A distal end 324 of connector assembly 322 is configured for removal and replacement of test specimens 312. In an embodiment, the distal end of the connector assembly includes a threaded receiver portion for engagement with a threaded connection member of a test specimen 312.

System 310 further includes a safety cover 360 having a top panel 361 from which side panels 362, 363 downwardly extend, and a movable loading window or panel 364. In this embodiment, the loading window or panel 364 is hingedly attached at the bottom portion of the safety cover 360 so that it can pivot between its open and closed positions. It is desirable for the protective shield 364 to be sized and configured so that when it is open, a user can easily access the test specimen 312 for its attachment to and removal from the shaft connector assembly 322. The top panel 361 includes an opening through which a portion of the rotatable shaft and/or shaft connector assembly 322 extend for positioning of the sample 312 in a generally vertical orientation within the safety cover 360.

The safety cover 360 further includes one or more slots or openings through which abrasive material can be inserted to allow a user to grind or polish surfaces of a test specimen with the safety cover 360 in its closed position. These slots may include any or all of horizontal slots 370, vertical slots 372, and angled slots (not shown) that are configured similar to slots 70, 72, 74 described above, for example. Alternatively, slots can be positioned in different locations and oriented differently than illustrated herein in order to position abrasive material to grind and/or polish different surfaces and/or using different approaches.

While the above discussion includes some processing steps that are included in the testing methods of ASTM D665, it is understood that the test methods and equipment described herein can be used in other applications (e.g., sanding and polishing of metal samples for decorative artwork) and a wide variety of other test methods that require processing of a cylindrical test specimen. Other exemplary test methods that may utilize test specimens include those in NACE TM0169, NACE TM0172, ASTM D3603, ASTM D7548, ASTM D7577, and ASTM G31.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

The invention claimed is:

1. A system for polishing an outer surface of a specimen, the system comprising:

a motor and a rotatable shaft extending from a first end of the motor, wherein the specimen is removably attachable to the rotatable shaft;

a safety cover configured to at least partially surround at least a portion of the rotatable shaft, the safety cover comprising:

a top panel;

a first side panel and a second side panel spaced from each other across a width of the safety cover and extending downwardly from the top panel; and at least one aperture extending through at least one of the first and second side panels; and an abrasive material insertable through the at least one aperture so that the abrasive material is positionable to contact the outer surface of the specimen.

2. The system of claim 1, wherein at least one aperture extends through both of the first and second side panels, and wherein the abrasive material is insertable through the at least one aperture of both of the first and second side panels.

3. The system of claim 1, wherein the safety cover further comprises an open position in which the rotatable shaft is accessible by a user.

4. The system of claim 3, wherein a portion of the safety cover that comprises the first and second side panels is moveable between the open position and a closed position of the safety cover.

5. The system of claim 3, wherein the safety cover further comprises a third panel that is moveable with respect to the first and second side panels between the open position and a closed position of the safety cover.

6. The system of claim 1, further including a safety interlock that only allows operation of the motor when the safety cover is in a closed position.

7. The system of claim 1, further comprising a magnetic source adjacent to the safety cover which is controllable to an activated condition and a deactivated condition.

8. The system of claim 1, further comprising a vacuum source positioned adjacent to an inner area of the moveable protective shield.

9. The system claim 1, wherein the safety cover comprises a fixed portion and a second portion that is moveable relative to the fixed portion.

10. The system claim 1, wherein the at least one aperture comprises at least one of a generally horizontal slot, a generally vertical slot, and an angled slot having a vertical component and a horizontal component.

11. The system of claim 1, further comprising at least one secondary opening extending through at least one of the first and second side panels for accepting an abrasive material for contact with a distal tip portion of the specimen.

12. The system of claim 1, wherein the top panel comprises an opening through which the rotatable shaft extends.

* * * * *